United States Patent [19]

Kay et al.

[11] Patent Number: 4,714,598

[45] **Date of Patent: * Dec. 22, 1987**

[54] METHODS OF DESULFURIZING GASES

[76] Inventors: D. Alan R. Kay, Burlington, Ontario, Canada; William G. Wilson, Allegheny County, Pittsburgh, Pa. 15229

[ * ] Notice: The portion of the term of this patent subsequent to Aug. 5, 2003 has been disclaimed.

[21] Appl. No.: 846,272

[22] Filed: Mar. 31, 1986

Related U.S. Application Data

[60] Division of Ser. No. 718,989, Apr. 2, 1985, Pat. No. 4,604,268, which is a continuation-in-part of Ser. No. 521,751, Aug. 8, 1983, Pat. No. 4,507,149, which is a continuation-in-part of Ser. No. 471,773, Mar. 3, 1983, which is a continuation of Ser. No. 174,024, Jul. 31, 1980, Pat. No. 4,397,683.

[51] Int. Cl.[4] ..... B01D 53/36; C01B 17/00; B01J 8/00

[52] U.S. Cl. ..... 423/230; 423/244

[58] Field of Search ..... 423/244 R, 244 A, 242 R, 423/242 A, 230

[56] References Cited

U.S. PATENT DOCUMENTS

| | | | |
|---|---|---|---|
| 1,912,455 | 6/1933 | Ingraham . | |
| 3,211,549 | 11/1965 | Kusaka | 75/134 |
| 3,784,374 | 1/1974 | Almaud | 75/129 |
| 3,795,505 | 3/1974 | Corradini | 75/53 |
| 3,816,103 | 6/1974 | Link | 75/53 |
| 3,818,869 | 6/1974 | Blaskowski | 122/5 |
| 3,909,212 | 9/1975 | Schroeder | 44/1 R |
| 3,974,256 | 8/1976 | Wheelock | 423/230 |
| 4,018,597 | 4/1977 | Staggers | 75/58 |
| 4,286,973 | 9/1981 | Hamlin | 55/92 |
| 4,290,805 | 9/1981 | Gorgerino | 75/120 R |
| 4,311,683 | 1/1982 | Hass et al. | 423/230 |
| 4,313,758 | 2/1982 | Henning | 75/130 R |
| 4,346,063 | 8/1982 | Cahn | 423/230 |
| 4,399,112 | 8/1983 | Voirin | 423/230 |

*Primary Examiner*—Gregory A. Heller

*Attorney, Agent, or Firm*—Buell, Ziesenheim, Beck & Alstadt

[57] ABSTRACT

A method for desulfurizing gases in which the sulfur is mainly in the form of hydrogen sulfide by reacting with one of the forms of cerium oxide with the formation of a cerium-oxygen-sulfur compound, which method can be conducted at temperatures as high as the lowest melting point of either the cerium oxides or cerium-oxygen-sulfur compounds formed by the reactions. The method also includes a definition of the temperature necessary for the regeneration of the cerium-oxygen-sulfur compounds back to cerium oxide which is capable of again reacting with the hydrogen sulfide of the gases being desulfurized whereby the emission of sulfur from the combustion of sulfur containing hydrocarbons is reduced to a level below that attainable with any other method when operated at the same high temperatures.

2 Claims, 3 Drawing Figures

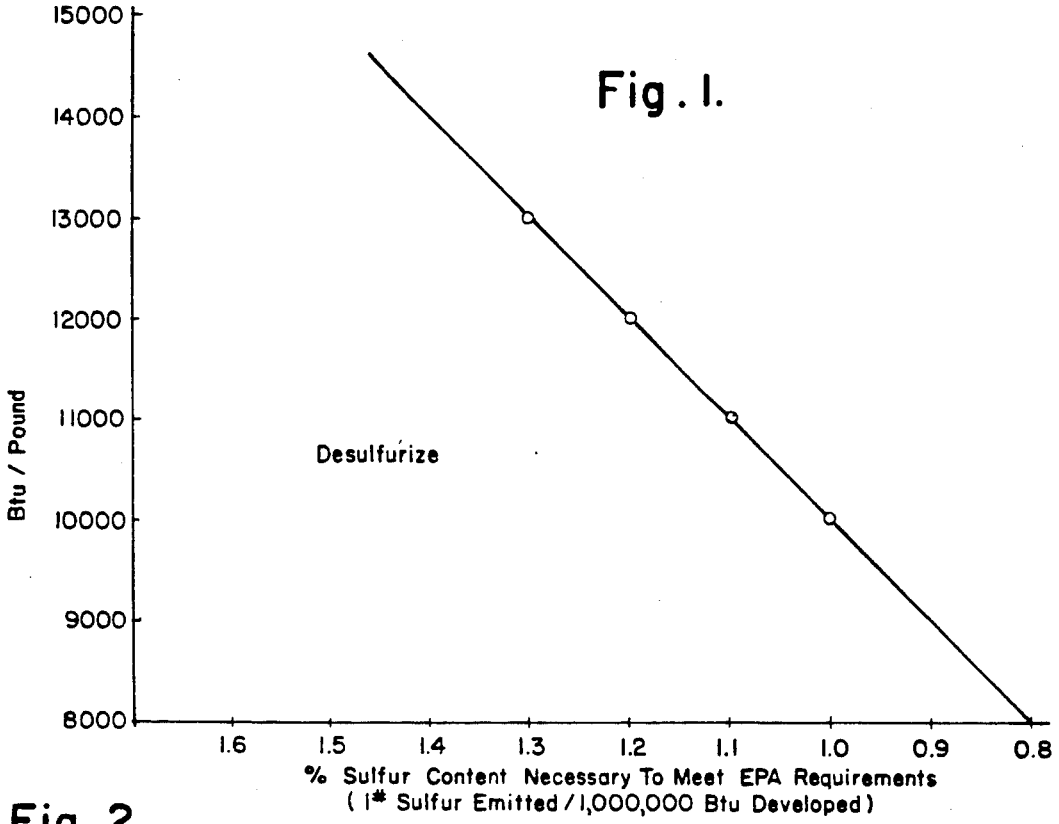
Fig. 2.
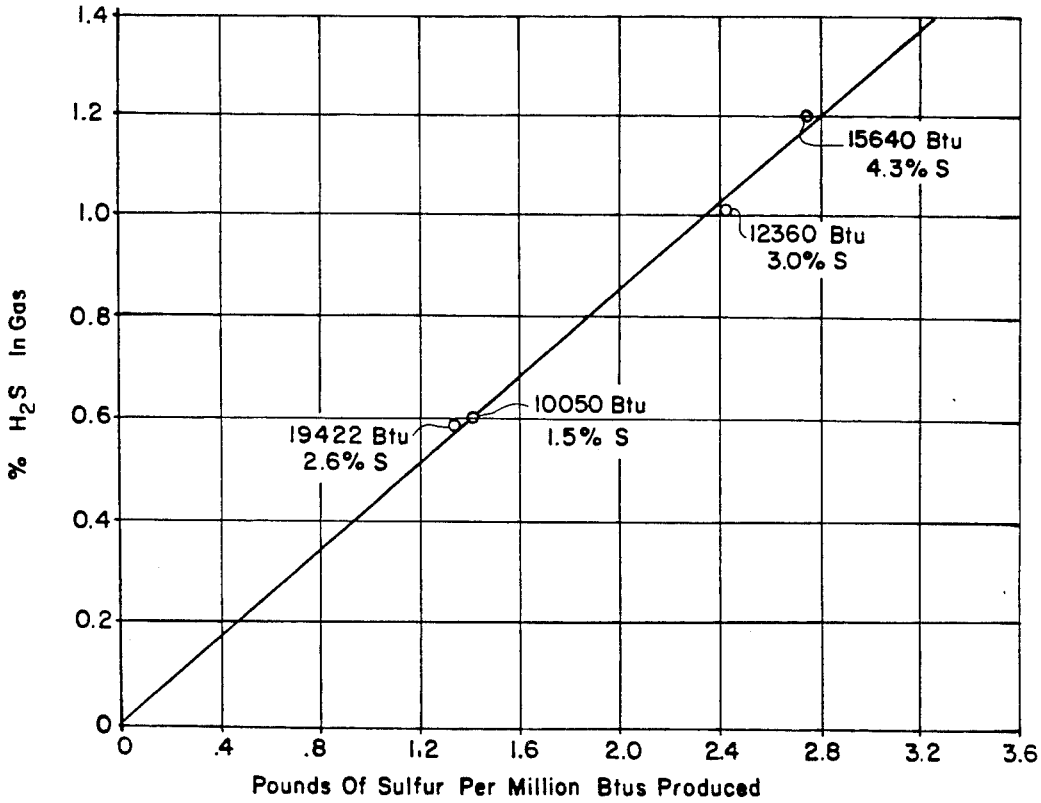

METHODS OF DESULFURIZING GASES

This application is a division of our copending application Ser. No. 718,989, filed Apr. 2, 1985 now U.S. Pat. No. 4,604,268. which application was a continuation-in-part of our application, Ser. No. 521,751 filed Aug. 8, 1983, now U.S. Pat. No. 4,507,149 which was a continuation-in-part of our application Ser. No. 471,773 filed Mar. 3, 1983, pending which was a continuation of our application Ser. No. 174,024 filed July 31, 1980 now U.S. Pat. No. 4,397,683.

This application relates to methods of desulfurizing gases and particularly to the desulfurization at high temperature of gases produced by the incomplete combustion of sulfur containing hydrocarbons in which the sulfur in the fuels has been converted mainly to hydrogen sulfide ($H_2S$) by reacting the $H_2S$ and other sulfur components with one of the forms of cerium oxide to levels which can be predicted based either on the ratio of $CO/CO_2$ or the ratio of $H_2/H_2O$ in the gases and to the temperature at which the desulfurization is conducted. This invention also includes a method for regeneration of the sulfur containing cerium compounds back to cerium oxide which is capable of again reacting with the hydrogen sulfide in gases in the same manner as the cerium oxides originally used for desulfurization.

The method of this invention is applicable to removal of sulfur prior to the complete combustion of the sulfur containing hydrocarbons presently being used for the generation of electrical power stations. The method may also be adapted to remove sulfur from the effluent of pyrometallurgical operations such as the winning of copper, lead and zinc ores in multi-hearth roasters and reverberatory furnaces.

This method differs from all of those described in the applications previously filed and those patents previously granted in that in all previous patents and appications there has been no differentiation between the ability of the individual rare earth elements (the term "rare earth", as used herein, includes the lanthanide rare earth elements having atomic numbers from 57 to 71, inclusive, and the element yttrium, atomic number 39, which is commonly found in rare earth concentrates and acts similarly to the rare earths in chemical separations) or the rare earths as a group to desulfurize fluid materials such as gases or liquids and neither has there been any differentiation between the individual rare earth elements as to the ease of their regeneration back to oxides capable of again reacting with the sulfur. In many instances, cerium was used in the equations and illustrations describing the processes of desulfurization of the various fluids and gases. It has been determined that those illustrations more closely describe the reactions that occur with other elements of the rare earth grbup exclusive of cerium.

The Congress of the United States has enacted legislation limiting the emission of sulfur from industrial processes. This legislation created the Environmental Protection Agency (EPA), and they have written regulations governing the sulfur content of emissions from power plants, multi-hearth roasters and reverberatory furnaces used for the winning of non non-ferrous metals from their ores. These EPA regulations state that the sulfur emission from the combustion of hydrocarbons in boilers providing the steam to operate turbine generators for the production of electricity shall be less than one pound of sulfur per million British thermal units (Btu) produced by the combustion of the fuel used in these plants The legal limit of emissions of sulfur from the stacks of multi-hearth roasters and reverberatory furnaces is so low that it is cheaper to refine many nonferrous ores outside the United States than to meet the EPA emission requirements.

At the 1976 Conference on Coal Gasification, held at the University of Pittsburgh, Mr. Keith Workman, Power Plant Supt. of the Bruce Mansfield Power Plant in Shippingport, Pa. presented figures on the cost of desulfurization of gases at this coal burning plant to be equal to the cost of a million Btu in steam coal of good quality. In addition, he indicated that there were severe operational problems with the lime based stack gas scrubbers being used as well as environmental problems associated with disposal of the waste material generated by the desulfurization. He also reported that there would be instances, when the atmospheric conditions were unfavorable that there would be high concentration acid rain in the immediate vicinity of the power plant because of the low temperature of the gases coming from the plant's smoke stack and their sulfur content. Similar costs and associated problems probably occur when desulfurization of the off-gases from pyrometallurgical operations is attempted.

We provide a method for desulfurizing the stack gases of power plants comprising the steps of interrupting the combustion of the sulfur containing hydrocarbons being burned in the plant while their composition is such that the sulfur contained in the gases is mainly in the form of hydrogen sulfide. The method we provide also will remove any sulfur carbonyl (COS) in the gases, but if the combustion of the sulfur containing hydrocarbons is so complete so that the sulfur is either all or in part in the form of sulfur dioxide ($SO_2$), the method we provide will not remove sulfur in that form.

We further provide a method for interrupting the combustion of sulfur containing hydrocarbons wherein the hydrocarbon is reacted in a gasifier in which the "water gas" reaction ($C+H_2O=H_2+CO$) is conducted. There are three general types of gasifiers in which the "water gas" reaction may be conducted: one, fixed bed; two, fluidized bed and three, entrained flow.

We further provide a method for interrupting the combustion of sulfur containing hydrocarbons wherein the hydrocarbon is reacted in a gasifier in which the "water gas" reaction is conducted. The $H_2S$ content of the gases from the gasifier can react with cerium oxides quickly to form sulfur containing cerium compounds. In the laboratory trials, the time from the introduction of the gases, which originally contained 1.2% $H_2S$ to reach the equilibrium value of 5 ppm was approximately five seconds. The cerium oxide was in the form of 0.2 millimeter pellets in a fixed bed reactor in this laboratory work.

We further provide a method for interrupting the combustion of sulfur containing hydrocarbons wherein the hydrocarbon is reacted in a gasifier in which the "water gas" reaction is conducted when the oxygen necessary for the gasifier to function is supplied either in the form of high purity oxygen or air.

We provide a method for desulfurizing stack gases of plants for the generation of electricity which use sulfur containing hydrocarbons as a fuel comprising the steps of interrupting the combustion of the sulfur containing fuel while the sulfur is in the form of $H_2S$ and allowing the gases to react with the oxide of one specific member of the rare earth group of elements, namely cerium, in a fluid bed reactor or a fixed bed reactor wherein the sulfur containing gases are able to come in contact with the cerium oxide resulting in the formation of sulfur containing cerium compounds. When medium Btu gases are produced in the gasifier in which the "water gas" reaction is being conducted, the $H_2S$ content of the gases after contact with the cerium oxide may be less than 100 ppm at temperatures as high as 1400° C.

We further provide a method for interrupting the combustion of sulfur containing hydrocarbons wherein the sulfur content of the coal may be either in a form which may be extracted by mineral dressing techniques which is known as "coal preparation" or the sulfur may be chemically bonded to the hydrocarbons in the coal and no means of "coal preparation" can reduce their content.

We further provide a method whereby the sulfur containing cerium compounds that result from the reaction of the cerium oxides with the sulfur in the gases whose sulfur content is mainly in the form of $H_2S$ can be regenerated back to cerium oxides which are again as capable of reacting with the $H_2S$ as virgin material comprising the steps of transferring the sulfur containing cerium compounds from the reactor where they have been in contact with the gases containing $H_2S$ to another reaction vessel maintaining the temperature of the sulfur containing cerium compounds in excess of 850° to 900° C., passing a stream of oxygen or air over the sulfur containing cerium compounds which will result in the release of high concentration $SO_2$ from the sulfur containing cerium compounds until the sulfur is gone and only cerium oxide remains. The temperature at which regeneration of other members of the rare earth group may be regenerated with similar procedures has been estimated to be between 1575° and 1670° C. nearly double the temperature at which sulfur containing cerium compounds can be regenerated and close to the melting point of almost all rare earth sulfur containing compounds.

We further provide a method for the regeneration of the sulfur containing cerium compounds resulting from the reaction of cerium oxide with gases containing sulfur in the form of $H_2S$ whereby the reaction for removal of the sulfur is conducted at a temperature sufficiently above the 850° to 900° C. regeneration temperature that the particles of sulfur containing cerium compounds do not have to be heated to maintain a temperature in excess of the 850° to 900° C. temperature necessary for regeneration.

We further provide that the stream of high concentration $SO_2$ resulting from the regeneration of the sulfur containing cerium compounds may be utilized to produce either high concentration sulfuric acid or elemental sulfur by anyone skilled in the art utilizing high concentration $SO_2$.

We further provide a method whereby the extent of the desulfurization with cerium oxide may be estimated based on the temperature of the gas and $CO/CO_2$ ratio at standard conditions (32° F. and one atmosphere of pressure) when the gas analysis is corrected so that it is on a dry basis (no water vapor). Based on the thermodynamic data in the patents previously granted and those applications which are co-pending, it is possible to estimate the degree of desulfurization that can be attained over a range of $CO/CO_2$ ratios of from one to ten and temperatures ranging from 800° to 1600° C.

We further provide a method whereby the extent of the desulfurization with cerium oxide may be estimated based on the temperature of the gas and $H_2/H_2O$ ratio which can be computed from the analysis of the gas if it is not given on a "dry" basis or after all water has been removed. In this case the ratio of $CO/CO_2$ is almost equal to the ratio of $H_2/H_2O$.

We further provide a method for improving the overall efficiency of the combustion of sulfur containing hydrocarbons wherein the gases resulting from the "water gas" reaction are never cooled to the temperature of boiling water as would be the case if desulfurization was to be done with aqueous solutions. The sensible heat in the gases from the gasifier after they are cooled to 2730° F. are equal to almost 20% of the calorific value because of the CO and $H_2$ in the gases. In competing systems for desulfurization of such gases, the sensible heat is recovered from the gases prior to desulfurization at boiling water temperatures or less by the installation of small steam boilers in the gas stream. However, when these gases whose temperature has been reduced to that of boiling water or lower are burned in the firebox of a boiler or some other device for utilizing their calorific value, the gases from the "water gas" reactor have to be heated by the calorific value of the gas due to its chemistry to the flame temperature that can be obtained when such gases are burned to utilize their calorific value. To raise these gases to their flame temperature will probably take almost 20% of the calorific value of the gases due to their chemistry. When desulfurization is achieved at high temperatures, most of the energy necessary to get the gases to flame temperature is already in the gases. As a result, the overall efficiency of combustion is improved by the number of calories in the sensible heat in the gases prior to their final combustion, which has been shown to be almost 20%.

We further provide a method whereby the temperature of the gases produced by the "water gas" reaction in a gasifier can have their temperature lowered and most of the ash from the coal entrained in the gas stream removed by passing the gases through a water walled or refractory walled cyclone. If the cyclone was water walled, it could extract heat from the gases so that they would be at a temperature which would permit more complete removal of the $H_2S$ or to prevent fusion or sintering of either the cerium oxides or the sulfur containing cerium compounds in the fluid bed reactor in which sulfur removal from the gases is conducted.

We further provide a method whereby the gases produced from sulfur containing hydrocarbons by the "water gas" reaction in a gasifier are desulfurized by reaction with cerium oxide to levels which are controlled by the composition of the gas and its temperature and such gases are used in the "combined cycle" process wherein the gases are first used to operate a gas turbine and the waste heat from the gas turbine is used to create steam in a boiler and that steam is then used to operate a conventional steam turbine. Each turbine has a generator attached which produces electric power.

We further provide a method for the desulfurization of gases resulting from the operation of a multi-hearth roaster or a reverberatory furnace which are used to eliminate sulfur from the ores of non-ferrous metals. The off gases from such roasters and furnaces are high in $SO_2$, and their temperature may be as high as 1000° C. This method provides that hydrocarbons be added to such gases in sufficient quantity that their sulfur content is converted to $H_2S$ and their $CO/CO_2$ ratio at standard conditions is greater than one. After such cases have been passed through a cyclone for the removal of particulate matter, they can be admitted to a fluid bed reactor containing rare earth oxides where desulfurization can be achieved in the same manner as the gases coming from a gasifier in which the "water gas" reaction is conducted. Alternatively, the gases coming from the roaster or reverberatory furnace might be used as a source of oxygen for conducting the "water gas" reaction in a gasifier and gases coming from the gasifier can be desulfurized in the same manner as any other gas from a gasifier where the "water gas" reaction is conducted.

The superiority of this invention over competing methods of sulfur removal include: desulfurization to levels far below that achievable with competing technology, more complete desulfurization with experimental data indicating 99.96% sulfur removal from gases whose original $H_2S$ content was 1.2%, desulfurization at high temperatures where the sensible heat in the gases coming from the gasifier in which the "water gas" reaction is conducted are essentially retained in the gases prior to their complete combustion thus materially increasing the over all efficiency of this method for burning sulfur containing hydrocarbons with a technology that also removes sulfur in the stack gases to very low levels, the ability to regenerate the cerium oxides used to remove the sulfur from the gases so that they can be used repeatedly for sulfur removal and the sulfur in the hydrocarbons can be released from the sulfur containing cerium compounds as concentrated $SO_2$ which can be converted either to high concentration sulfuric acid or elemental sulfur—both of which are items of commerce.

In the foregoing general description of our invention we have set out certain objects, purposes and advantages. Other objects, purposes and advantages of this invention will be apparent from the following description and the accompanying drawings in which:

FIG. 1 is a graph of Btu/pound of coal vs. % Sulfur necessary to meet EPA requirements;

FIG. 2 is a graph of % $H_2S$ in gas compared to pounds of sulfur per million Btus produced.

Figure 3:
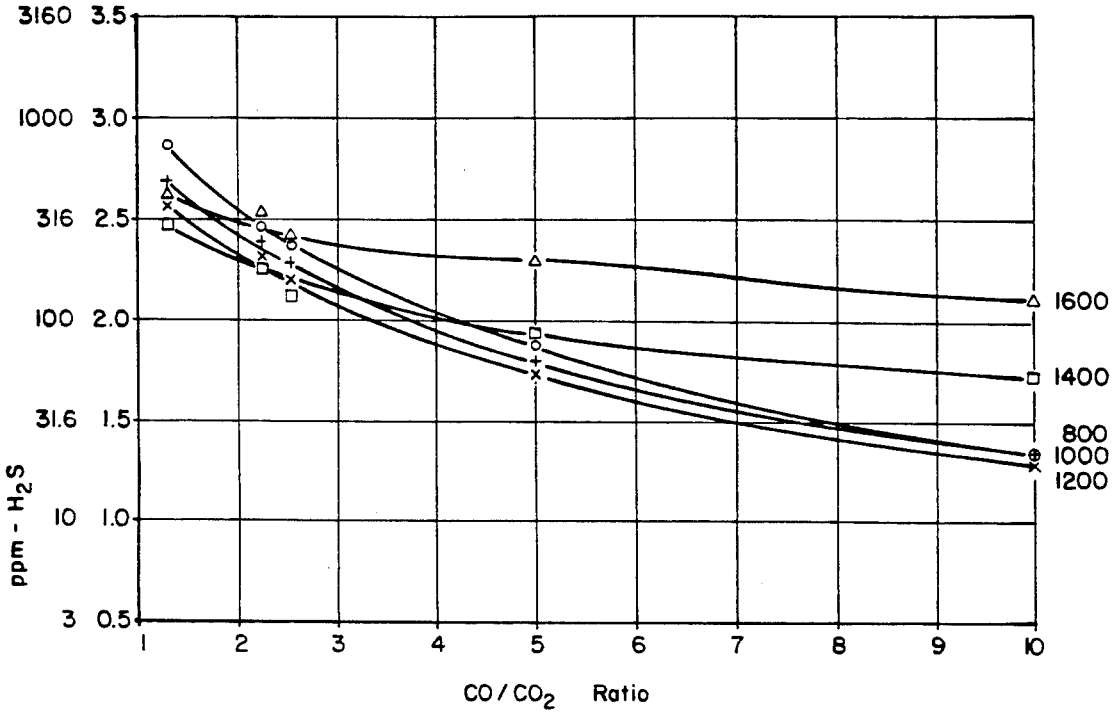
FIG. 3 is a graph of $H_2S$ in ppm compared to the room temperature $CO/CO_2$ ratio of the gas.

In the following Table I we have shown the amount of coal consumed in the United States, its Btu value, sulfur content and cost:

TABLE I

FOSSIL FUEL CONSUMPTION, QUALITY & COST 1976–1980

| | 1976 | 1977 | 1978 | 1979 | 1980 |
|---|---|---|---|---|---|
| COAL | | | | | |
| Consumption ($10^6$ Tons) | 446.70 | 477.47 | 479.47 | 525.25 | 564.48 |
| Avg. BTU/LB ($10^3$) | 10.85 | 11.02 | 11.01 | 10.71 | 10.70 |
| Avg. Sulfur % | 2.10 | 2.00 | 1.90 | 1.70 | 1.60 |
| Avg. $/Ton | 18.40 | 20.08 | 26.67 | 26.14 | 28.76 |
| Avg. $/MMBTU | .85 | .95 | 1.10 | 1.20 | 1.31 |
| OIL | | | | | |
| Consumption ($10^6$) | 502.17 | 559.76 | 570.08 | 481.51 | 388.95 |
| Avg. BTU/GAL ($10^3$) | 146.44 | 146.38 | 142.73 | 147.40 | 147.91 |
| Avg. | 1.00 | .90 | .70 | 1.00 | 1.00 |

TABLE I-continued

FOSSIL FUEL CONSUMPTION, QUALITY & COST 1976–1980

| | 1976 | 1977 | 1978 | 1979 | 1980 |
|---|---|---|---|---|---|
| Sulfur % | | | | | |
| Avg. $/BBL | 12.17 | 13.68 | 14.29 | 18.76 | 26.79 |
| Avg. $/MMBTU | 1.97 | 2.23 | 2.38 | 3.03 | 4.32 |
| GAS | | | | | |
| Consumption ($10^6$) | 2,905.19 | 2,975.81 | 2,931.39 | 3,183.84 | 3,363.85 |
| Avg. BTU/MCF ($10^3$) | 1.03 | 1.03 | 1.02 | 1.03 | 1.03 |
| Avg. $/MCF | 1.06 | 1.33 | 1.47 | 1.80 | 2.28 |
| Avg. $/MMBTU | 1.00 | 1.30 | 1.40 | 1.70 | 2.21 |

Based on present EPA limits of sulfur emission per million Btu, FIG. 1 has been drawn, and it shows that any combination of the Btus/pound of coal and its sulfur content that is above the line in FIG. 1 requires no desulfurization to meet existing EPA standards. Any combination below the line in FIG. 1 will require desulfurization. On average, all of the coal burned in the United States in 1980 which had a Btu value per pound of 10700 and a sulfur content of 1.6% would require desulfurization of the stack gases to meet present EPA requirements.

The relationship between the pounds of sulfur in the coal per million Btus and the $H_2S$ content of the resulting gas from the gasifier, which would have a Btu content per standard cubic foot (standard cubic foot=a cubic foot of gas at 32° F. and one atmosphere pressure) of approximately 300 if oxygen is used to fire the gasifier, is shown in FIG. 2. At the permissible limit for sulfur emissions (one pound of sulfur per million Btu produced by combustion) the $H_2S$ content of the gas cannot exceed 0.45% or 4500 part per million (ppm). Laboratory trials of desulfurization of such gases with cerium oxide at 1575° F. gave indicated that $H_2S$ levels of less than 5 ppm have been achieved.

As we have pointed out above, based on the thermodynamic data available it is possible to estimate the degree of desulfurization attainable over a range of $CO/CO_2$ ratio from one to ten and temperatures ranging from 800° to 1600° C.

The results of these calculations are presented graphically in FIG. 3. They show that at $CO/CO_2$ ratios from 1 to 4 it is possible to reduce the $H_2S$ content of gases resulting from the "water gas" reaction to less than 1000 ppm (4500 ppm is the present EPA limit) at temperatures as high as 1600° C. When medium Btu gases which contains approximately 300 Btu/scf (scf=a standard cubic foot or a cubic foot of gas at 32° F. and one atmosphere of pressure) is produced by the "water gas" reaction the $CO/CO_2$ ratio is generally in excess of 4. Such gases can be desulfurized to less than 100 ppm of $H_2S$ at temperatures less than 1400° C. The one point on FIG. 3 which represents the laboratory trials indicates desulfurization may be possible to even lower values of $H_2S$ than have been calculated based on thermodynamic data. The laboratory trial which was conducted at 812° C. reached equilibrium with a fixed bed of cerium oxide pellets about 0.1 mm in diameter in 4.5 seconds at a $H_2S$ level of about 7 ppm. Because of the many measurements involved in development of thermodynamic data, it is possible that this could be the cause of the discrepancy between the calculated and experimental data. Neither is it possible to completely exclude the possibility of some oversight in the experimental procedure that could account for this discrepancy. It is important that in any case both calculations and experimental data indicate removal of $H_2S$ from gases produced from gasifiers is to levels well below those required to meet current EPA requirements.

The reaction time necessary to desulfurize "water gas" reactor type gases has been found to be rapid. When experiments with gases of a composition typical of those produced in gasifiers (55% CO, 10.8% $CO_2$, 33% $H_2$ and 1.2% $H_2$) were conducted at 1575° F., it was found that with cerium oxide pellets of an average diameter of 0.42 millimeters, it took 4.5 seconds for the reaction to come to equilibrium with the $H_2S$ in the gas being passed over the pellets in a fixed bed reactor. In practice, it may not be necessary to use such large pellets. The cerium oxide as supplied by Union Oil-Molycorp has a surface area as great as 5 square meters per gram. Computations show that the surface area of the chemical oxide per gram is approximately 2500 times greater than the surface area of the pellets used in the desulfurizing experiments. Since the rate of reaction will be strongly influenced by the surface area of the cerium oxide exposed to the sulfur containing gases, increasing the area of the cerium oxide 2500 times should reduce the reaction times drastically.

Of the major advantages of desulfurization of medium Btu gases with cerium compounds is that the compounds containing the sulfur after completion of desulfurization can be regenerated back to cerium oxides and reused for desulfurizing the $H_2S$ containing gases with little or no loss of their desulfurizing capabilities. Regeneration is accomplished either by passing air or oxygen over the sulfur containing compounds. When the oxygen potential of the gases is increased with an addition of air or oxygen to the system, regeneration occurs if the temperature is greater than 1575° F. Since it is expected that the desulfurization reaction will be carried out at temperatures in excess of 1575° F., it should be possible to carry out this regeneration without having to heat the sulfur containing rare earth compounds formed during the desulfurization of the medium Btu gases containing sulfur.

As mentioned above, there are a number of reactors that are used in which the "water gas" reaction may be conducted. The data that was available to applicants was obtained from Koppers and are based on their trials and experience with their reactor, and this engineering summary is based on the data contained in their paper entitled KOPPERS-TOTZEK: TAKE A LONG HARD LOOK By D. Michael Mitsak and John F. Kamody presented at the second annual symposium on "Coal Gasification, Liquefaction and Utilization: Best Prospects for Commercialization" University of Pittsburgh, Pittsburgh, Pa.; Aug. 5–7, 1975.

Since the present EPA requirements for sulfur emission are based on pounds of sulfur allowed to escape into the air per million Btu of fuel burned, a relationship exists between the calorific value of the hydrocarbon being burned and its sulfur content. The data in Figure shows that there are some combinations of calorific value and sulfur that will not require desulfurization to meet present requirements, but other comhinations will. In cases where desulfurization is required, it is proposed that the desulfurization of the gas be carried out in a fluid bed reactor downstream of the K-T unit. In the fluid bed reactor, the cerium oxide and the gases from the K-T unit are brought into contact with each other. Desulfurized gases are then used to fire a boiler.

However, prior to their introduction into the fluid bed reactor, the gases may require a reduction in temperature and removal of the ash not previously eliminated in the K-T unit itself. A cyclone is one of the means of achieving this objective. Research on synthetic fuel production has shown that 99+ % of the ash can be removed from a system like that proposed. Such a cyclone could contain water tubes or be water walled for the production of steam which would reduce the temperature of the gases going through the cyclone while at the same time removing any slag carried over from the K-T unit by the swirling action generated in the cyclone. Temperature reduction would only be to the level necessary to prevent rapid attack of the refractories in the fluid bed reactor where desulfurization of the gases takes place and low enough to be below the sintering temperature of the cerium oxides and sulfur containing compounds. The temperature should remain high enough throughout the sulfur removal regeneration cycle that regeneration of the sulfur containing compounds will occur without further additions of temperature to the sulfur containing cerium compounds.

The reaction times for desulfurization given above can be used to estimate the size of the fluid bed reactor necessary to desulfurize the gases produced by firing 2400 tons of 3% sulfur coal per day in a K-T unit when pellets 0.4 millimeters in diameter are used. These calculations indicate that a reactor 30 feet high and 20 feet in diameter would be required when such a system was operating at or near atmospheric pressure. Recent data on synthetic fuel production in Germany (Coal Gasification and Liquefaction for Energy Supply in the Federal Republic of Germany, IRONMAKING & STEELMAKING 1984 Volume 11 Number 3) indicates that the gasifiers currently being built or proposed are to run at pressures as high as 40 atmospheres. Operating at such high pressure should materially reduce the size of the fluid bed reactors required for the desulfurization of gases with cerium oxides. The feasibility of a fluid bed reactor for conducting this desulfurization is most promising, but confirming trial must be conducted.

Regeneration would be accomplished in another fluid bed reactor. The sulfur containing cerium compounds formed by the desulfurization of the gases from the K-T unit would be discharged from the desulfurizing fluid bed reactor without being allowed to cool and conveyed to the second fluid bed reactor in the system. The sulfur containing cerium compounds would be fluidized by the air or oxygen used for regeneration. The high concentration $SO_2$ would be carried off from the fluid bed reactor to be converted to high concentration sulfuric acid or elemental sulfur. The regenerated cerium oxides, whose temperature would be in as high or higher than the minimum regeneration temperature of 1575° F. would be reintroduced into the fluid bed reactor used for desulfurization.

The steam generated in the cyclone used for cooling the gases or eliminating any remaining slag could become all or part of the steam necessary to run the K-T unit itself, or because of the volume of steam produced, some might be piped into the steam drum of the main boiler of the system.

In the foregoing specification we have set out certain preferred practices and embodiments of our invention, however, it will be understood that this invention may be otherwise embodied within the scope of the following claims.

We claim:

1. A method for desulfurizing gases formed by the incomplete combustion of sulfur containing hydrocarbons at high temperature in which gases the sulfur is mainly in the form of one of hydrogen sulfide and sulfur carbonyl whereby the sulfur is removed to sufficiently low levels that when combustion of the gases is completed the gases emitted the atmosphere have a sulfur content which is less than one pound of sulfur per million British thermal units produced by combustion of fuel or its equivalent comprising the steps of:

a. Controlling the incomplete combustion of the sulfur containing hydrocarbons so that the ratio of carbon monoxide to carbon dioxide ($CO/CO_2$) ratio at standard conditions (32° F. and one atmosphere pressure) is greater than one; and b. Reacting the gases whose $CO/CO_2$ ratio is greater than one and whose sulfur content is in the form of either $H_2S$ and sulfur carbonyl (COS) with cerium oxide, whereby the $H_2S$ content of the desulfurized gases is less than 1000 part per million when the ratio of the $CO/CO_2$ is greater than one and the temperature is less than 1600° C.

2. The method of desulfurizing gases as claimed in claim 1 whereby the $H_2S$ content of the desulfurized gases is less than 120 ppm when the ratio of $CO/CO_2$ is greater than four and the temperature of desulfurization is less than 1400° C.

* * * * *

UNITED STATES PATENT AND TRADEMARK OFFICE

CERTIFICATE OF CORRECTION

PATENT NO. : 4,714,598

DATED : December 22, 1987

INVENTOR(S) : D. ALAN R. KAY, WILLIAM G. WILSON

It is certified that error appears in the above-identified patent and that said Letters Patent is hereby corrected as shown below:

Column 1, line 5, after 4,604,268 change "." to --,--.

Column 1, line 38, change "appications" to --applications--.

Column 1, line 55, change "grbup" to --group--.

Column 2, line 2, after "plants" insert --.--.

Column 7, line 63, after "Figure" insert --2--.

Column 7, line 66, change "comhinations" to --combinations--.

Column 9, line 14, Claim 1, after "emitted" insert --into--.

Signed and Sealed this

Sixteenth Day of August, 1988

*Attest:*

*Attesting Officer*

DONALD J. QUIGG

*Commissioner of Patents and Trademarks*